US010857689B2

(12) United States Patent
Rawlings

(10) Patent No.: US 10,857,689 B2
(45) Date of Patent: Dec. 8, 2020

(54) CONDUIT CUTTING ASSEMBLY

(71) Applicant: Zids Tool, LLC, Chattanooga, TN (US)

(72) Inventor: Michael Rawlings, Chattanooga, TN (US)

(73) Assignee: Zids Tools, LLC, Chattanooga, TN (US)

( * ) Notice: Subject to any disclaimer, the term of this patent is extended or adjusted under 35 U.S.C. 154(b) by 40 days.

(21) Appl. No.: 16/230,007

(22) Filed: Dec. 21, 2018

(65) Prior Publication Data

US 2020/0198166 A1 Jun. 25, 2020

(51) Int. Cl.
*B26D 7/22* (2006.01)
*B26D 7/00* (2006.01)
*B26D 3/00* (2006.01)

(52) U.S. Cl.
CPC ..... *B26D 7/22* (2013.01); *B26D 3/001* (2013.01); *B26D 7/0006* (2013.01)

(58) Field of Classification Search
CPC ..... B26D 7/22; B26D 7/0006; B26D 3/001
See application file for complete search history.

(56) References Cited

U.S. PATENT DOCUMENTS 2,559,387 A * 7/1951 Baker ..... H01B 15/006 83/438
3,805,382 A * 4/1974 Benedict, Jr. ..... H02G 1/1217 30/90.4
3,905,736 A * 9/1975 Bringman ..... B26D 3/001 425/308
4,062,110 A * 12/1977 Alvarez ..... H02G 1/1297 30/90.8
4,611,585 A * 9/1986 Steidle ..... A61F 15/02 30/124
4,625,405 A * 12/1986 Hudnutt ..... A61F 15/02 30/370
4,977,671 A 12/1990 Ducret
5,020,226 A * 6/1991 Chabbert ..... A61F 15/02 30/390

(Continued)

FOREIGN PATENT DOCUMENTS

AU 2012101642 B4 7/2013
DE 10252022 B4 11/2005

(Continued)

*Primary Examiner* — Omar Flores Sanchez
(74) *Attorney, Agent, or Firm* — Pitts & Lake, P.C.

(57) ABSTRACT

A conduit cutting assembly is comprised of a conduit cutting surface, a drive shaft, a top shield and a bottom guide. The conduit cutting assembly is inserted into a rotary device which provides a torque to rotate the conduit cutting assembly. The shield glides along the top surface of the conduit preventing deeper penetration of the cutting surface and deflecting dust as conduit is cut. The guide is positioned on the internal side of the conduit and prevents the cutting surface from contacting encased wiring. The distance between the bottom surface of the shield and the top surface of the guide is closely aligned to the conduit wall thickness. Conduit cutting assemblies can be customized for conduit material and conduit wall thickness. The conduit cutting assembly safely cuts through conduit without damaging encased wiring, limits incidental contact with the cutting surface, and limits contact with dust generated through the cutting procedure.

6 Claims, 2 Drawing Sheets

(56) References Cited

U.S. PATENT DOCUMENTS

| | | | | |
|---|---|---|---|---|
| 5,943,778 | A * | 8/1999 | Alana | B23D 21/08 30/101 |
| 6,014,810 | A * | 1/2000 | Earle | B23D 45/006 30/101 |
| 6,044,744 | A * | 4/2000 | Eslambolchi | H02G 1/1239 30/90.7 |
| 6,202,307 | B1 * | 3/2001 | Wrate | B23D 21/08 30/101 |
| 6,247,235 | B1 | 6/2001 | Lawler | |
| 6,378,212 | B1 | 4/2002 | Belew | |
| 6,487,776 | B2 | 12/2002 | Chang | |
| 6,637,115 | B2 | 10/2003 | Walsh et al. | |
| 6,739,055 | B2 | 5/2004 | Lee | |
| 6,895,671 | B1 | 5/2005 | Belew et al. | |
| 6,966,731 | B2 | 11/2005 | VanderPol | |
| 7,152,325 | B2 | 12/2006 | Green et al. | |
| 7,406,769 | B1 | 8/2008 | Toussaint | |
| 7,743,510 | B2 | 6/2010 | Lazarevic | |
| 7,743,688 | B2 | 6/2010 | Jellinghausen | |
| 8,061,249 | B1 | 11/2011 | Kaehr et al. | |
| 8,069,757 | B2 | 12/2011 | Ross | |
| 8,191,266 | B2 | 6/2012 | Ducret | |
| 8,297,882 | B2 | 10/2012 | Tjader | |
| 8,333,236 | B2 | 12/2012 | Guidry et al. | |
| 8,689,449 | B2 | 4/2014 | Lazarevic | |
| 9,088,144 | B2 * | 7/2015 | Ducret | H02G 1/1217 |
| 2006/0037198 | A1 | 2/2006 | Sullivan | |
| 2012/0279366 | A1 | 11/2012 | Tjader | |
| 2013/0340257 | A1 | 12/2013 | Nasiell | |
| 2019/0234550 | A1 * | 8/2019 | Keyes | B29C 44/08 |
| 2019/0360310 | A1 * | 11/2019 | Mireles | E21B 41/00 |

FOREIGN PATENT DOCUMENTS

| | | | |
|---|---|---|---|
| GB | 2352662 | A | 2/2001 |
| WO | WO2001019550 | A1 | 3/2001 |

* cited by examiner

CONDUIT CUTTING ASSEMBLY

TECHNICAL FIELD

The present disclosure relates a conduit cutting assembly used to cut and remove conduit. A conduit cutting assembly is equipped with a cutting surface connected to a safety top and a safety tip such that the safety top can glide along the outer surface of the conduit, the cutting surface can cut a strip through the conduit, and the safety tip prevents the cutting surface from making contact with the encased wiring. The safety top and safety tip can improve the safety and quality of cutting conduit by shielding the user from the cutting surface, preventing the encased wiring from being cut, and by serving as a dust shield.

BACKGROUND

Conduit is a raceway which provides mechanical protection to wiring such as conductors and cables and allows for future wiring changes. Encased wiring may need to be accessed for maintenance purposes, therefore the protective conduit may need to be removed after wiring has been installed. Example tools that can be used to cut conduit include tube cutters, wire saws, hack saws, reciprocating saws, or other similar devices. Each of the example tools has the potential to cut into the wiring encased within the conduit and each has a cutting surface that can be exposed to the device operator. The operator can be injured if incidental contact is made with the cutting surface.

A need exists for a conduit cutting device to cut conduit without cutting into the wiring encased within the conduit and without injuring the operator of the conduit cutting device.

BRIEF SUMMARY OF THE INVENTION

Techniques herein provide a conduit cutting assembly for cutting and removing conduit with wiring encased within the conduit. As a cutting device is used to cut into or through a piece of conduit, the cutting device can make contact with the enclosed wiring potentially cutting or damaging the wiring. If the cutting device makes contact with the device operator, the operator can be injured. The conduit cutting assembly can remove the possibility of damaging the encased wiring and reduce the risk of injuring the device operator.

Conduit can be composed of a variety of materials depending upon the specific application in which the conduit is being used. Conduit can be rigid, semi-rigid, or flexible. Conduit can be composed of high density polyethylene (HDPE), polyvinyl chloride (PVC), electrical metallic tube (EMT), electrical non-metallic tube (ENT), flexible steel, flexible aluminum, or other materials suitable to provide mechanical protection to encased wiring.

The conduit cutting assembly can be used to remove conduit or expose the encased wiring. By cutting a single strip through the surface of the conduit, the conduit can be extended such that the conduit may be removed or the encased wiring can be accessed. The conduit cutting assembly can also be used to cut any number of strips through the surface of the conduit such that the conduit can be removed in two or more sections.

The conduit cutting assembly may be driven by a hand held rotary device such as a drill or other suitable rotary tool. The rotary device may be powered by a 120-volt alternating current motor assembly, a rechargeable battery powered direct current motor assembly, or other suitable power supply.

The conduit cutting assembly can be comprised of a drive shaft, a conduit cutting surface, a safety top, and a safety tip. The drive shaft, conduit cutting surface, safety top, and safety tip can be constructed of low carbon steel, high carbon steel, high speed steel, colbalt, or any other suitable material with a hardness suitable to cut through a specific type of conduit. In an example embodiment, the conduit cutting assembly can be comprised of low carbon steel and used to cut through PVC conduit. In another example embodiment, the conduit cutting assembly can be comprised of colbalt and used to cut through EMT conduit.

The conduit cutting surface can be coated with black oxide, titanium nitride, or any other suitable material. The coating can make the cutting surface harder, more lubricated, sharper, or more heat resistant thereby improving the cutting quality, durability, and lifespan of the conduit cutting surface.

The drive shaft can be inserted into the rotary device. The drive shaft of the conduit cutting assembly can be rotated by the motor assembly of the rotary device, thereby producing a rotating conduit cutting surface. The rotating conduit cutting surface can be placed in contact with a section of conduit, directed longitudinally along the length of the section of conduit, thereby producing a longitudinal cut through the conduit.

In an example embodiment, the drive shaft, conduit cutting surface, safety top, and safety tip of the conduit cutting assembly can be forged or tooled from a single solid piece of material such as the materials previously described. In another example embodiment, the drive shaft, conduit cutting surface, safety top, and safety tip can be constructed separately and assembled to construct the conduit cutting assembly. The drive shaft, conduit cutting surface, safety top, and safety tip can each be constructed of the same material or each component can be constructed of different materials to customize the conduit cutting assembly to the specific cutting requirement. The safety top and safety tip can be affixed to the conduit cutting surface through the use of a ball bearing or other suitable attachment device. The safety top, conduit cutting surface, and safety tip can be press fitted, interference fitted, or assembled in any other suitable manner.

While the rotating conduit cutting surface of the conduit cutting assembly is in contact with the lateral cross section of the conduit, the safety top can glide along the outer surface of the conduit wall. The safety top can serve as a guide to prevent the conduit cutting surface from penetrating deeper into the conduit thereby preventing contact with the encased wiring. The safety top can also serve as a shield to limit or prevent dust from coming into contact with the device operator.

The safety tip can glide along the inner surface of the conduit wall thereby preventing the conduit cutting surface from contacting the encased wiring. The combination of the safety top and safety tip can provide a shield to prevent incidental contact between the conduit cutting surface and the device operator.

The distance between the bottom surface of the safety top and the top surface of the safety tip can be a distance which closely aligns with the conduit wall thickness. In an example embodiment, the height of the conduit cutting surface can be approximately 1/16" larger than the conduit wall. For a conduit wall thickness of 1/4" the height of the conduit cutting surface can be 5/16". In other example embodiments, the distance between the bottom surface of the safety top and the top surface of the safety tip can be customized to closely align the height of the conduit cutting surface with the conduit wall thickness.

DESCRIPTION OF THE INVENTION

Reference will be made to example embodiments of the present general inventive concept, examples of which are illustrated in the accompanying drawings and illustrations. The example embodiments described herein are presented in order to explain the present general inventive concept by referring to the figures.

Figure 1:
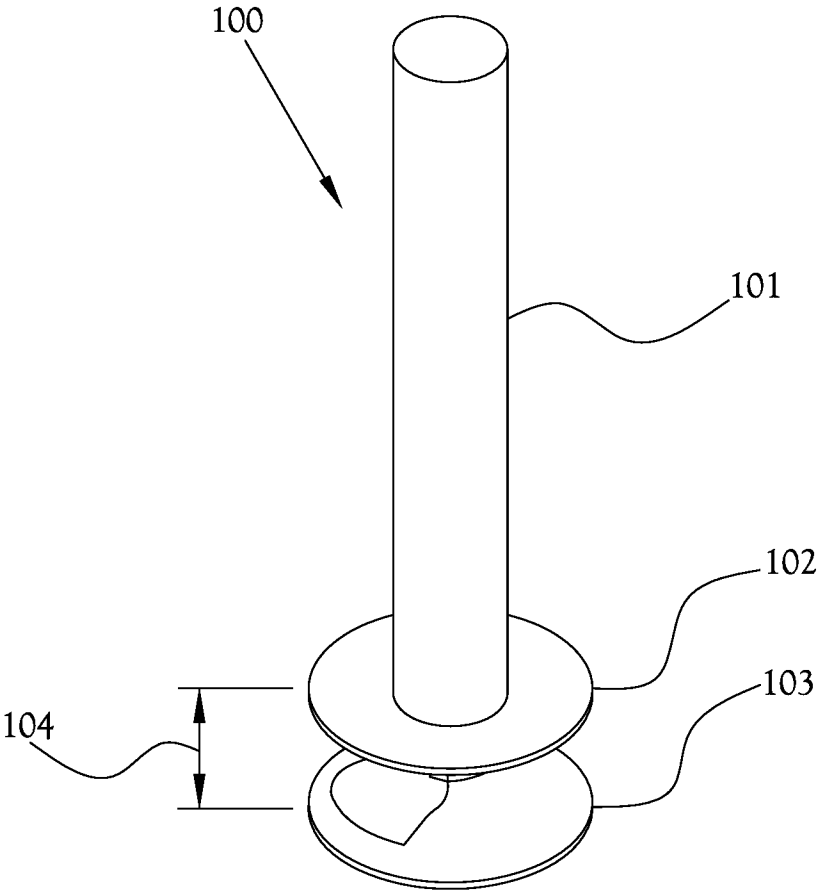
FIG. 1 is an illustration depicting a front perspective view of a conduit cutting assembly.

FIG. 1 is an illustration depicting a front perspective view of a conduit cutting assembly 100. A drive shaft 101 is shown with a safety top 102 and a safety tip 103. The safety top 102 and the safety tip 103 are separated by a longitudinal distance 104. The conduit cutting assembly 100 can be attached to a rotary tool 301, which will be described in reference to FIG. 3, by inserting drive shaft 101 into the rotary tool 301.

In an example embodiment, the drive shaft 101 can have dimensions of ¼" diameter and 1" height. The safety top 102 can have dimensions of 1/32" thickness and 9/16" diameter. The safety tip can have dimensions of 1/16" thickness and ⅜" diameter. The longitudinal distance 104 can be 5/16" tapering to ¼". The tapering will be further illustrated in reference to FIG. 2.

Figure 2:
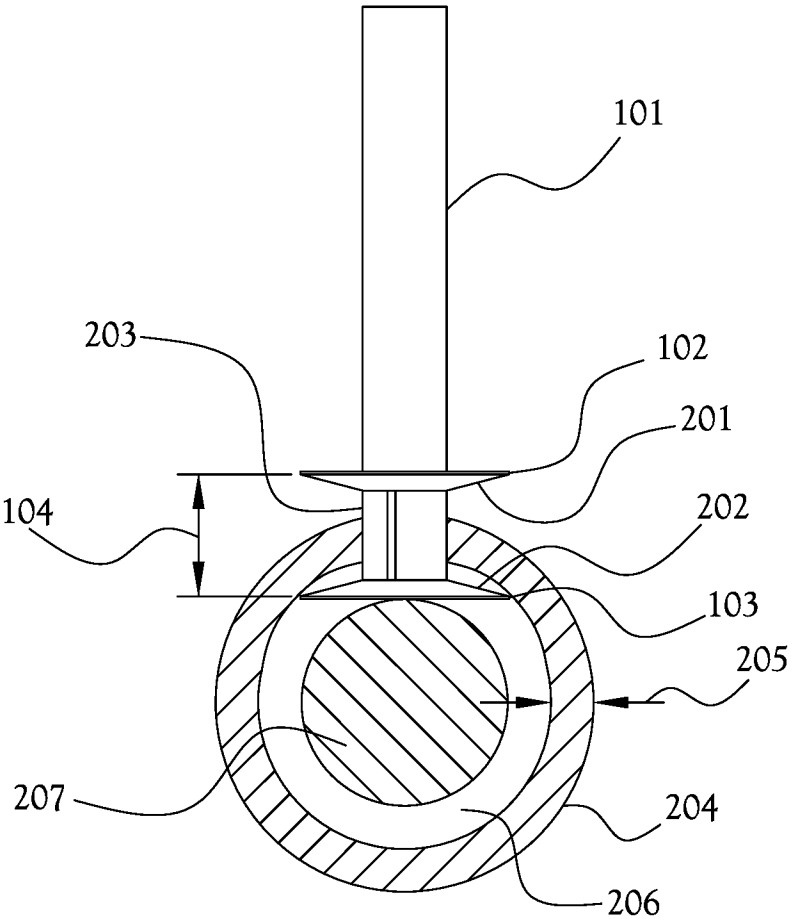
FIG. 2 is an illustration depicting a front perspective view of the conduit cutting assembly as the conduit cutting assembly would be used in relation to a cross section of the conduit with encased wiring, in accordance with certain example embodiments.

FIG. 2 is an illustration depicting a front perspective view of the conduit cutting assembly 100. FIG. 2 illustrates a tapering 201 of safety top 102 and a tapering 202 of safety tip 103. FIG. 2 illustrates a conduit cutting surface 203. In an example embodiment, the longitudinal distance 104 can be 5/16" tapering to ¼" as illustrated by tapering 201 and tapering 202. The height of conduit cutting surface 203 can be ¼".

FIG. 2 illustrates conduit cutting assembly 100 in a front perspective view in relation to a cross sectional view of conduit 204. Conduit 204 has a conduit wall thickness 205 and a spacing 206 between the inside surface of conduit 204 and encased wiring 207.

Figure 3:
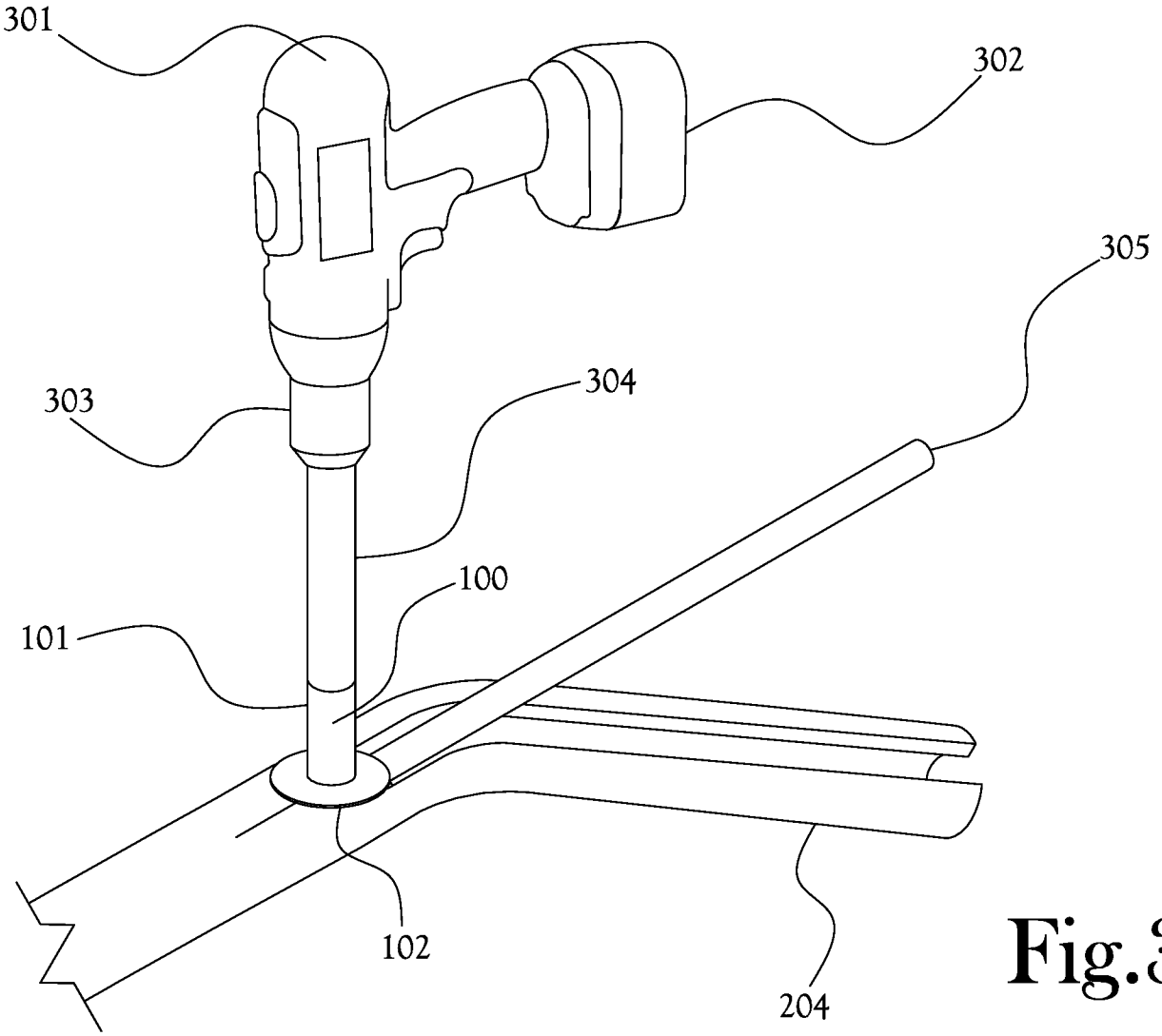
FIG. 3 is an illustration depicting the conduit cutting assembly affixed to a rotary device in use to cut a strip from a conduit section.

FIG. 3 is an illustration depicting the conduit cutting assembly 100 affixed to a rotary device 301. Rotary device 301 can have a power supply 302. Power supply 302 can be a 120-volt alternating current motor assembly, a rechargeable battery powered direct current motor assembly, or other suitable power supply.

Rotary device 301 can have a chuck 303. Drive shaft 101 can be inserted into chuck 303, wherein chuck 303 can be tightened to affix conduit cutting assembly 100 to rotary device 301. In an alternate embodiment, an extension 304 can be inserted into chuck 303 and affixed to rotary device 301. Conduit cutting assembly 100 can be affixed to extension 304 through a male—female coupling system or other suitable assembly method.

FIG. 3 illustrates a strip 305 being removed from conduit 204 through the use of conduit cutting assembly 100 as configured with rotary device 301, extension 304, and chuck 303.

While the present general inventive concept has been illustrated by description of several example embodiments, it is not the intention of the applicant to restrict or in any way limit the scope of the inventive concept to such descriptions and illustrations. Instead the descriptions, drawings, and claims herein are to be regarded as illustrative in nature and not restrictive, and additional embodiments will readily appear to those skilled in the art upon reading the above description and reviewing the drawings.

What is claimed is:

1. A method to use a conduit cutting assembly to cut conduit piping, comprising:

inserting the conduit cutting assembly into a rotary tool, the conduit cutting assembly comprising a cutting surface, a shield, and a guide;

rotating the conduit cutting assembly through the use of the rotary tool;

placing the rotating conduit cutting assembly into contact with the lateral surface of a conduit piping wall; and cutting into conduit piping into which material is encased;

wherein the shield glides along the outer surface of the conduit piping.

2. The method of claim 1, wherein the cutting surface of the conduit cutting assembly is aligned with the cross-sectional lateral surface of the conduit piping wall.

3. The method of claim 1, wherein the cutting surface is directed longitudinally along the length of the section of conduit piping.

4. The method of claim 1, wherein the guide prevents the cutting surface from contacting material encased within the conduit piping.

5. The method of claim 1, wherein the rotary tool is a hand held rotary device.

6. The method of claim 5, wherein the hand held rotary device is a drill.

* * * * *